US005417071A

United States Patent [19]

Inaguchi

[11] Patent Number: 5,417,071

[45] Date of Patent: May 23, 1995

[54] LOW-TEMPERATURE REGENERATIVE TYPE REFRIGERATOR

[75] Inventor: Takashi Inaguchi, Hyogo, Japan

[73] Assignee: Mitsubishi Denki Kabushiki Kaisha, Tokyo, Japan

[21] Appl. No.: 267,384

[22] Filed: Jun. 29, 1994

Related U.S. Application Data

[62] Division of Ser. No. 6,483, Jan. 21, 1993, Pat. No. 5,345,770.

[30] Foreign Application Priority Data

| | | | |
|---|---|---|---|
| Jan. 29, 1992 | [JP] | Japan | 4-013918 |
| Feb. 24, 1992 | [JP] | Japan | 4-036230 |
| Aug. 21, 1992 | [JP] | Japan | 4-221863 |

[51] Int. Cl.[6] ..... F25B 9/00

[52] U.S. Cl. ..... 62/6; 62/132; 60/520

[58] Field of Search ..... 62/6, 132; 60/520

[56] References Cited

U.S. PATENT DOCUMENTS

| | | | |
|---|---|---|---|
| 3,802,211 | 4/1974 | Bamberg | 62/6 |
| 3,991,586 | 11/1976 | Acord | 62/6 |
| 4,724,676 | 2/1988 | Lewis | 62/6 |

FOREIGN PATENT DOCUMENTS

| | | | |
|---|---|---|---|
| 46-10255 | 3/1971 | Japan | 62/6 |
| 0302563 | 12/1990 | Japan | 62/6 |
| 3070942 | 3/1991 | Japan | 62/6 |
| 3075457 | 3/1991 | Japan | 62/6 |
| 1695068 | 11/1991 | U.S.S.R. | 62/6 |

OTHER PUBLICATIONS

P. Hrycak, "Thermodynamic Analysis of a New Gag Refrigeration Cycle", (Bell Labs), *Cryogenics*, vol. 3, No. 1, Mar. 1963.

*Primary Examiner*—Christopher Kilner

*Attorney, Agent, or Firm*—Burns, Doane, Swecker & Mathis

[57] ABSTRACT

Disclosed is a low-temperature regenerative type refrigerator installed in a low temperature environment, in which a cooling water flow rate controller for adjusting the flow rate of cooling water automatically in accordance with the temperature of gas fed to an expansion unit from a compressor, is provided in a water cooling type cooler for cooling the compressor, to keep the temperature of the gas discharged from the compressor high to the extent of not deteriorating the function of a seal due to shrinkage or not causing convection or deflecting flow in a regenerator, whereby it is made possible to prevent the deterioration in the cooling efficiency of the regenerator which is caused by a lowering of the ambient temperature in the refrigerator installed place, and hence possible to prevent the deterioration of the refrigerating capacity as the entire refrigerator.

1 Claim, 14 Drawing Sheets

LOW-TEMPERATURE REGENERATIVE TYPE REFRIGERATOR

This application is a divisional of application Ser. No. 08/006,483, filed Jan. 21, 1993, now U.S. Pat. No. 5,345,770.

BACKGROUND OF THE INVENTION

1. Field of the Invention

The present invention relates to a low-temperature regenerative type refrigerator to be used for cooling at an ultra-low temperature, e.g. MRI.

2. Description of the Prior Art

FIG. 1 is a construction diagram showing a single stage type Gifford McMahon cycle refrigerator which is a kind of a conventional low-temperature regenerative type refrigerator as disclosed, for example, in Japanese Patent Publication No. 10255/71. In the same figure, a displacer (a movable member) 2 is provided within a cylinder 1 into which is charged a cooling gas. A regenerator 3 is fitted in the displacer 2, and it is constituted by a phosphor bronze mesh or lead balls. The displacer 2 is reciprocated vertically in the figure within the cylinder 1 by means of an operating rod 4 extending through the upper portion of the cylinder 1.

By such movement of the displacer 2 there are formed a room temperature space 5 and an expansion space 6 within the cylinder 1. A seal 7 is mounted the outer peripheral portion of the displacer 2 to provide a hermetic seal between the spaces 5 and 6. The displacer 2 is provided with gas passages **2*a* and 2*b* for communication between the space 5 and the regenerator 3 and between the space 6 and the regenerator 3, respectively. An expansion unit 8 is constituted by the cylinder 1, displacer 2, regenerator 3, operating rod 4 and seal 7**.

A compressor unit 10 is connected to the normal temperature space 5 through a pipe 9. The compressor unit 10 comprises a compressor 11 for compressing gas which is exhausted from the cylinder 1, a water cooling type cooler 12 for cooling the compressor 11 using a cooling water **12*a*, a low pressure-side surge tank 13, a high pressure-side surge tank 14, an exhaust valve 15 and an intake valve 16**.

The operation of such conventional refrigerator will now be described. Gas (e.g. helium gas ) compressed by the compressor 11 is fed to the high pressure-side surge tank 14. If the intake valve 16 is open, the gas in the tank 14 flows into the room temperature space 5 of the expansion unit 8. The gas which has thus entered the space 5 passes through the gas passage **2*a*, then through the regenerator 3 which has been cooled in the previous cycle, whereby it is heat-exchanged (cooled), thereafter the gas thus cooled passes through the gas passage 2*b* and enters the expansion passage 6. At this time, there is no fear of the gas flowing directly between the spaces 5 and 6 because the seal 7 is provided on the outer periphery of the displacer 2. The gas thus entered the expansion space 6** expands and generates low-temperature heat to cool an article to be cooled (not shown).

Thereafter, the gas passes reversely through the regenerator 3 to cool the regenerator and reaches the room temperature space 5. Also at this time, the gas will never flow directly between the spaces 5 and 6. This exhaust-side gas passes through the exhaust valve 15 which is in an open condition, then reaches the low pressure-side surge tank 13 and is again compressed by the compressor 11. The compressor 11 is cooled by flowing the cooling water **12*a* into the water cooling type cooler 12**.

When the conventional low-temperature regenerative type refrigerator constructed as above is operated at a low ambient temperature, the temperature of the gas flowing into the expansion unit 8 also becomes low because it is apt to be influenced by the ambient temperature. As the temperature of the gas flowing into the expansion unit 8 thus drops, the seal 7 shrinks and its function is deteriorated, resulting in that it becomes easier for the gas to leak and there occurs convection or deflecting flow within the regenerator 3, thus causing a marked deterioration of the heat exchange efficiency. Consequently, the no load temperature (the temperature of the expansion space 6) as the low-temperature regenerative refrigerator rises and the refrigerating capacity is markedly deteriorated. FIG. 2 shows the results of an experiment conducted to check the influence of the intake temperature upon the no load temperature in this type of a low-temperature regenerative type refrigerator. Also from this figure it is recognized that the no load temperature rises as the intake temperature drops. Also when the cylinder 1 is installed in a place where the temperature of the seal 7 sliding portion of the cylinder becomes low, the seal shrinks and the function thereof is deteriorated, thus causing deterioration of the refrigerating capacity.

SUMMARY OF THE INVENTION

In view of the foregoing, it is an object of the present invention to provide a low-temperature regenerative type refrigerator whose refrigerating capacity is not deteriorated even when installed in a place where the ambient temperature is low.

It is another object of the present invention to provide a low-temperature regenerative type refrigerator capable of preventing the leakage of gas from a seal more positively.

According to the first aspect of the present invention, for achieving the above-mentioned objects, there is provided a low-temperature regenerative type refrigerator having a cooling water flow rate controller which controls the flow rate of a cooling water in a water cooling type cooler in accordance with the temperature of gas fed from a compressor to an expansion unit.

According to the second aspect of the present invention, there is provided a low-temperature regenerative type refrigerator having an air-cooling fan controller which controls the number of revolutions of an air-cooling fan of an air cooling type cooler in accordance with the temperature of gas fed from a compressor to an expansion unit.

According to the third aspect of the present invention, there is provided a low-temperature regenerative type refrigerator having a heater for heating gas which is fed from a compressor to an expansion unit and also having a heater controller for controlling the quantity of heat of the heater in accordance with the temperature of the gas.

According to the fourth aspect of the present invention, there is provided a low-temperature regenerative type refrigerator having a heater disposed on an outer peripheral portion of a cylinder for heating gas fed to an expansion unit and also for heating a seal, and further having a heater controller which controls the quantity of heat of the heater in accordance with the temperature gas fed from a compressor to the expansion unit.

As stated above, in the low-temperature regenerative refrigerators according to the first and second aspect of the present invention, the temperature of the gas discharged from the compressor is adjusted to keep the temperature of the gas flowing from the compressor into the expansion unit high to the extent of preventing the deterioration in function of the seal and preventing the occurrence of convection or deflecting flow in the regenerator.

Further, in the low-temperature regenerative type refrigerator according to the third aspect of the present invention, the gas fed to the expansion unit is heated to prevent shrinkage of the seal which would cause deterioration of its function and also prevent the occurrence of convection or deflecting flow in the regenerator.

Furthermore, in the low-temperature regenerative type refrigerator according to the fourth aspect of the present invention, both the gas fed to the expansion unit and the seal are heated to prevent shrinkage of the seal which would lead to deterioration of its function and also prevent the occurrence of convection or deflecting flow in the regenerator.

The above and further objects and novel features of the invention will more fully appear from the following detailed description when the same is read in connection with the accompanying drawing. It is to be expressly understood, however, that the drawings are for purpose of illustration only and are not intended as a definition of the limits of the invention.

DETAILED DESCRIPTION OF THE PREFERRED EMBODIMENTS

Figure 1:
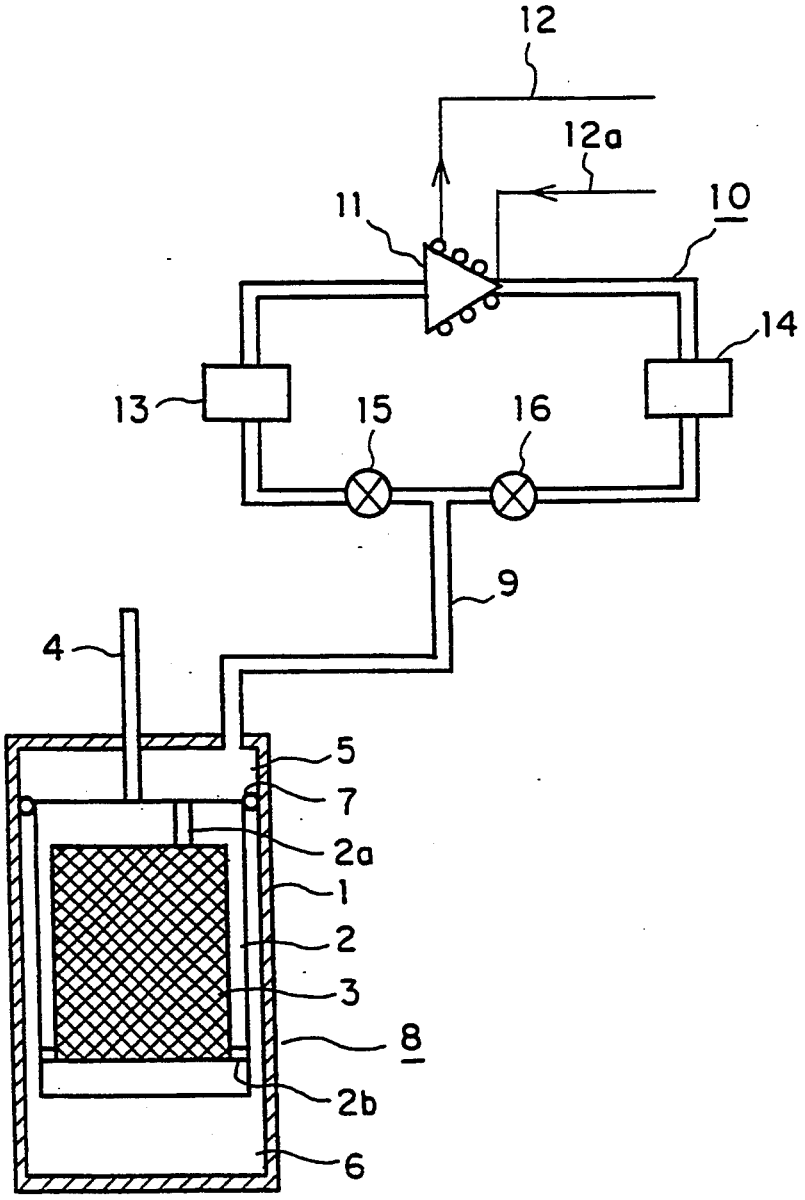
FIG. 1 (PRIOR ART)
FIG. 1 is a construction diagram showing an example of a conventional low-temperature regenerative type refrigerator.
Figure 2:
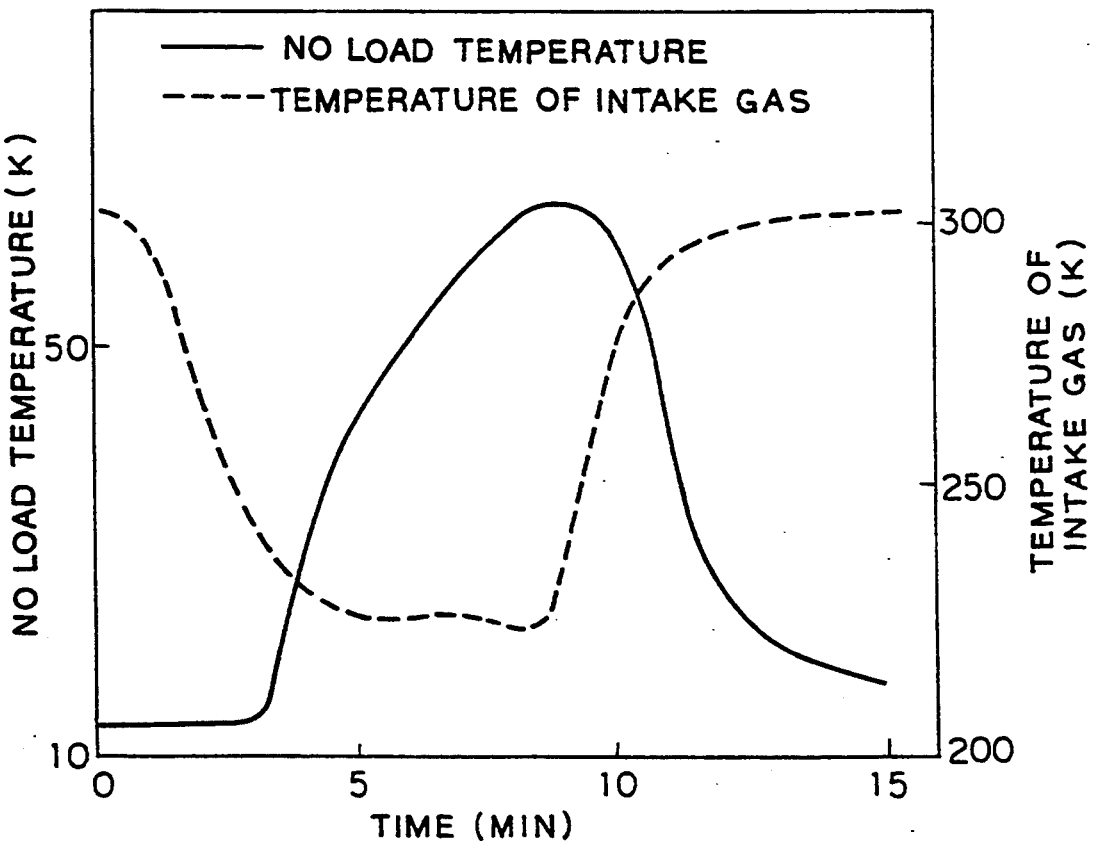
FIG. 2 is a diagram showing a relation between changes in the temperature of intake gas and changes in reached temperature in the refrigerator of FIG. 1.

Preferred embodiments of the invention will now be described in detail referring to the accompanying drawings, in which the component parts common to FIG. 1 are designated by common reference numerals. The descriptions of the common component parts are omitted here to avoid unnecessary repetition.

Embodiment 1

Figure 3:
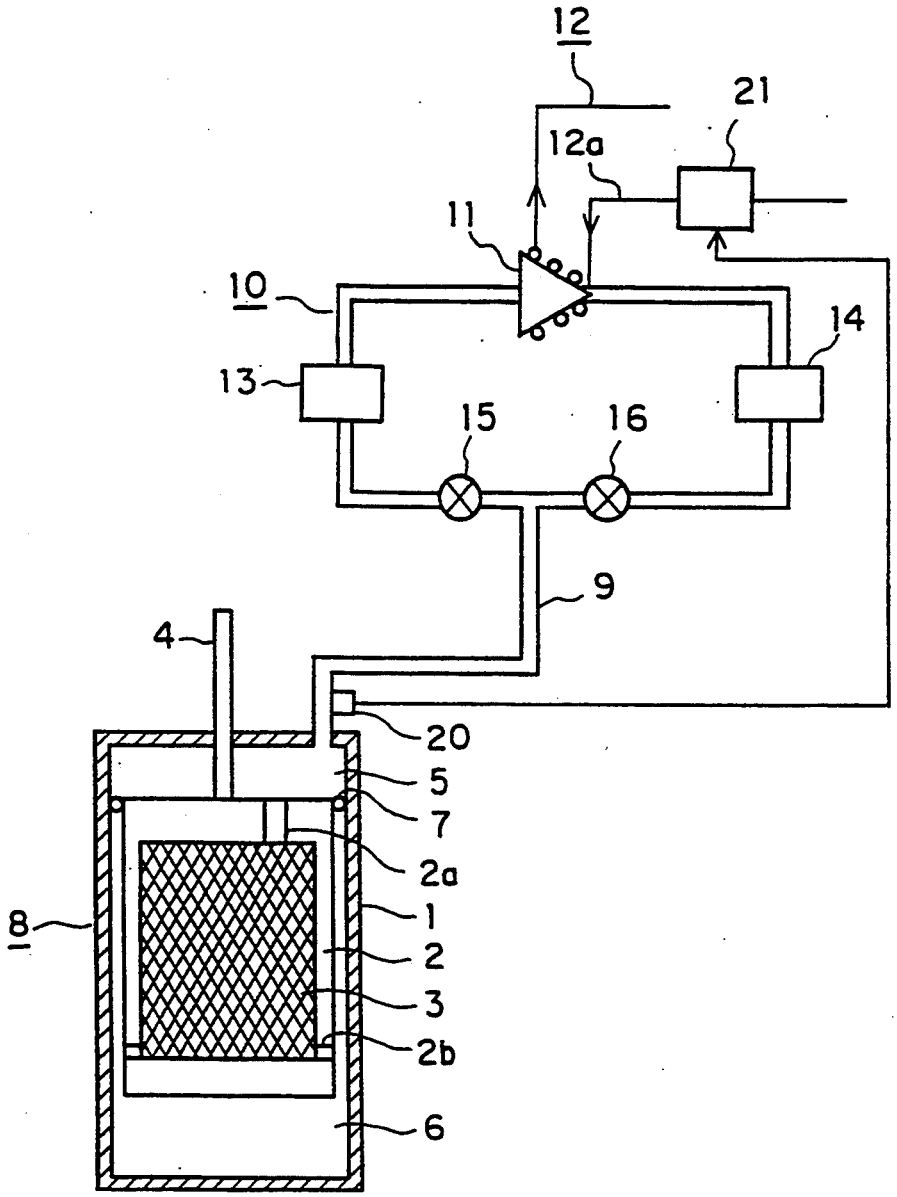
FIG. 3 is a construction diagram showing a low-temperature regenerative type refrigerator according to a first embodiment in the first aspect of the present invention.

FIG. 3 is a construction diagram showing a single stage type Gifford McMahon cycle refrigerator according to a first embodiment in the first aspect of the present invention.

In the same figure, a cooling water flow rate controller 21 is disposed in a flow path of a cooling water 12*a* in a water cooling type cooler 12. The controller 21 is connected to a temperature sensor 20 which is disposed near a cylinder 1-side end portion of a pipe 9, and it controls the flow rate of the cooling water 12*a* automatically in accordance with the temperature of gas which is discharged from a compressor 11 and fed to an expansion unit 8.

The operation of this refrigerator will now be described. The temperature of the gas discharged from the compressor 11 varies depending on the flow rate of the cooling water 12 for cooling the compressor 11. In more particular terms, the higher the flow rate of the cooling water 12*a*, the lower the gas temperature, while the lower the cooling water flow rate, the higher the gas temperature. Therefore, if the flow rate of the cooling water 12*a* is adjusted low by the cooling water flow rate controller 21 when the gas temperature has dropped below a certain temperature level, the gas temperature will rise. By making such a control, the temperature of the gas discharged from the compressor 11 can be maintained higher than a desired temperature.

Consequently, even if the refrigerator is installed in a place where the ambient temperature is low, the temperature of the gas flowing into the expansion unit 9 can be kept higher than a certain constant temperature. As a result, the deterioration in function of the seal 7 caused by its thermal shrinkage is prevented to prevent the leakage of gas between a room temperature space 5 and an expansion space 6. Also prevented is the occurrence of convection or deflecting flow when the gas passes through the regenerator 3. Therefore, the heat exchange efficiency of the regenerator 3 is not deteriorated and the refrigerating capacity of the entire refrigerator is also prevented from being deteriorated.

Further, since an increase in temperature of the gas discharged from the compressor 11 is attained by reducing the flow of the cooling water 12*a* without using a heater or the like, the heat which has so far been wasted is utilized effectively, thus affording a high efficiency.

Embodiment 2

Figure 4:
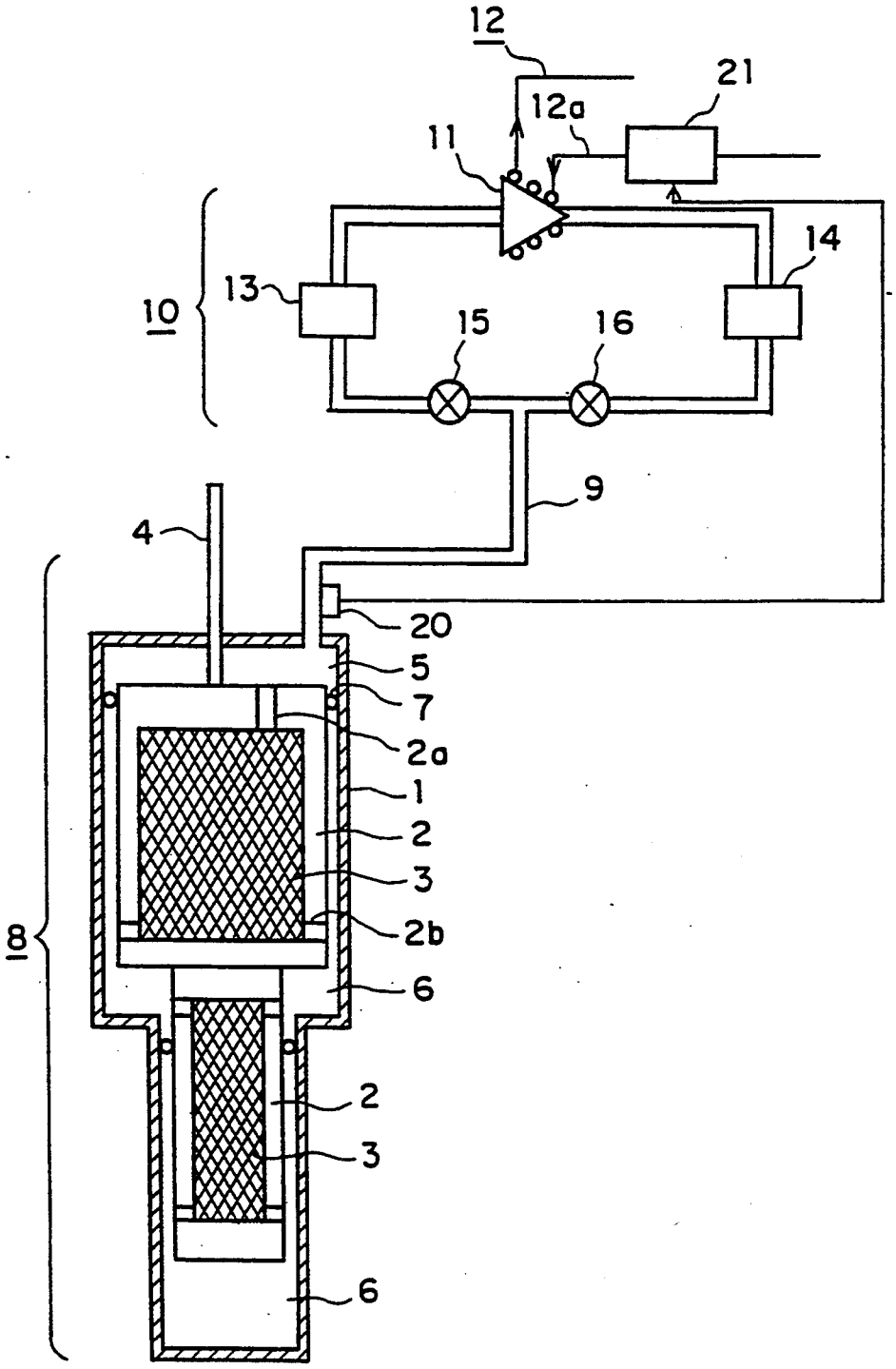
FIG. 4 is a construction diagram showing a low-temperature regenerative type refrigerator according to a second embodiment in the first aspect of the invention.

FIG. 4 is a block diagram showing a two-stage type Gifford McMahon cycle refrigerator according to a second embodiment in the first aspect of the present invention. As illustrated in the same figure, by providing a cooling water flow rate controller 21 in the water cooling type cooler 12 which cools the compressor 11, the same effect as in the single stage type can be expected also in the two-stage type.

Embodiment 3

Figure 5:
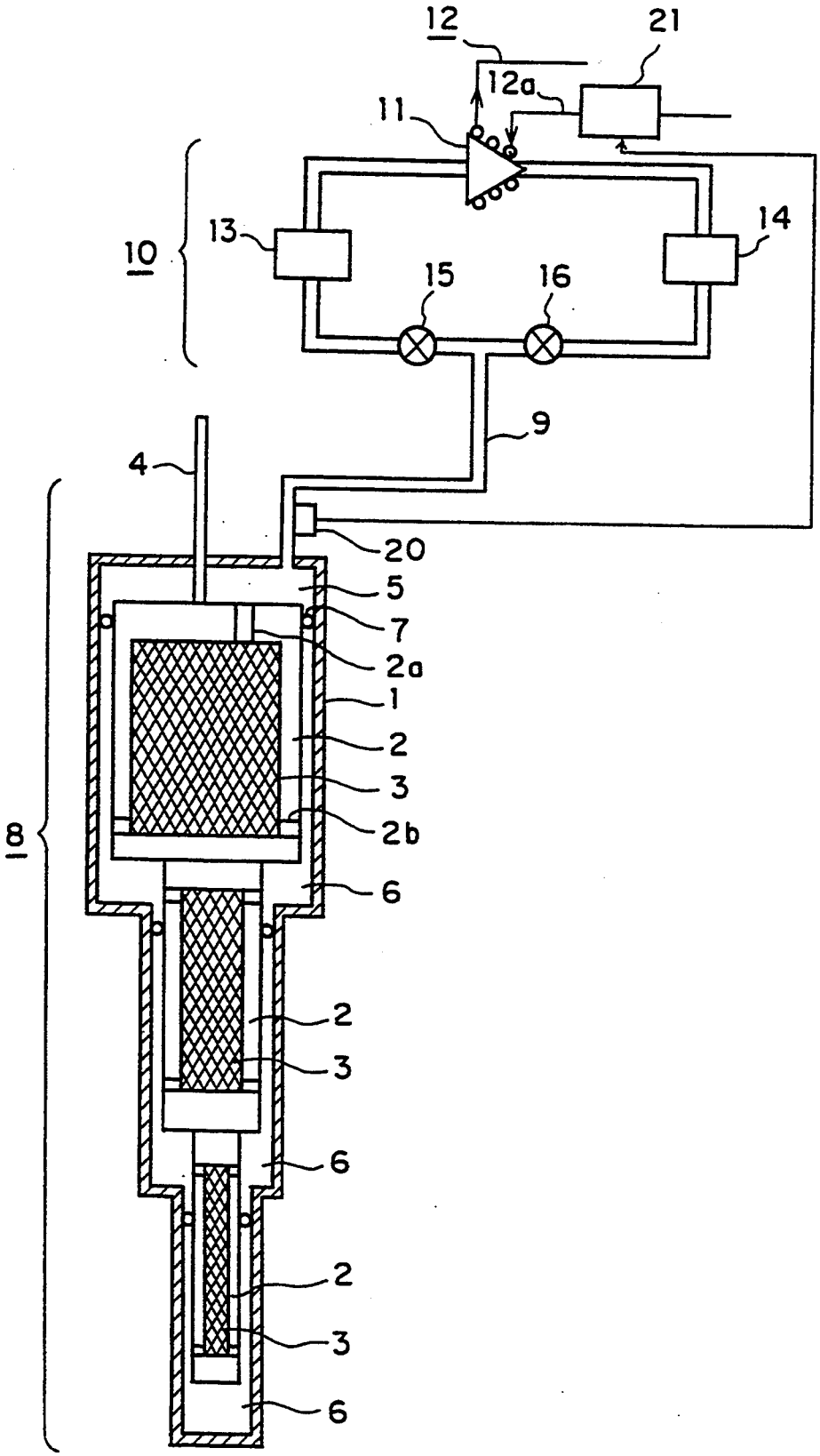
FIG. 5 is a construction diagram showing a low-temperature regenerative type refrigerator according to a third embodiment in the first aspect of the invention.

FIG. 5 is a construction diagram showing a three-stage type Gifford McMahon cycle refrigerator according to a third embodiment in the first aspect of the present invention. As illustrated in the same figure, by providing a cooling water flow rate controller 21 in the water cooling type cooler 12 which cools the compressor 11, the same effects as in the single stage type can be expected also in a multi-stage type of three or more stages.

Embodiment 4

Figure 6:
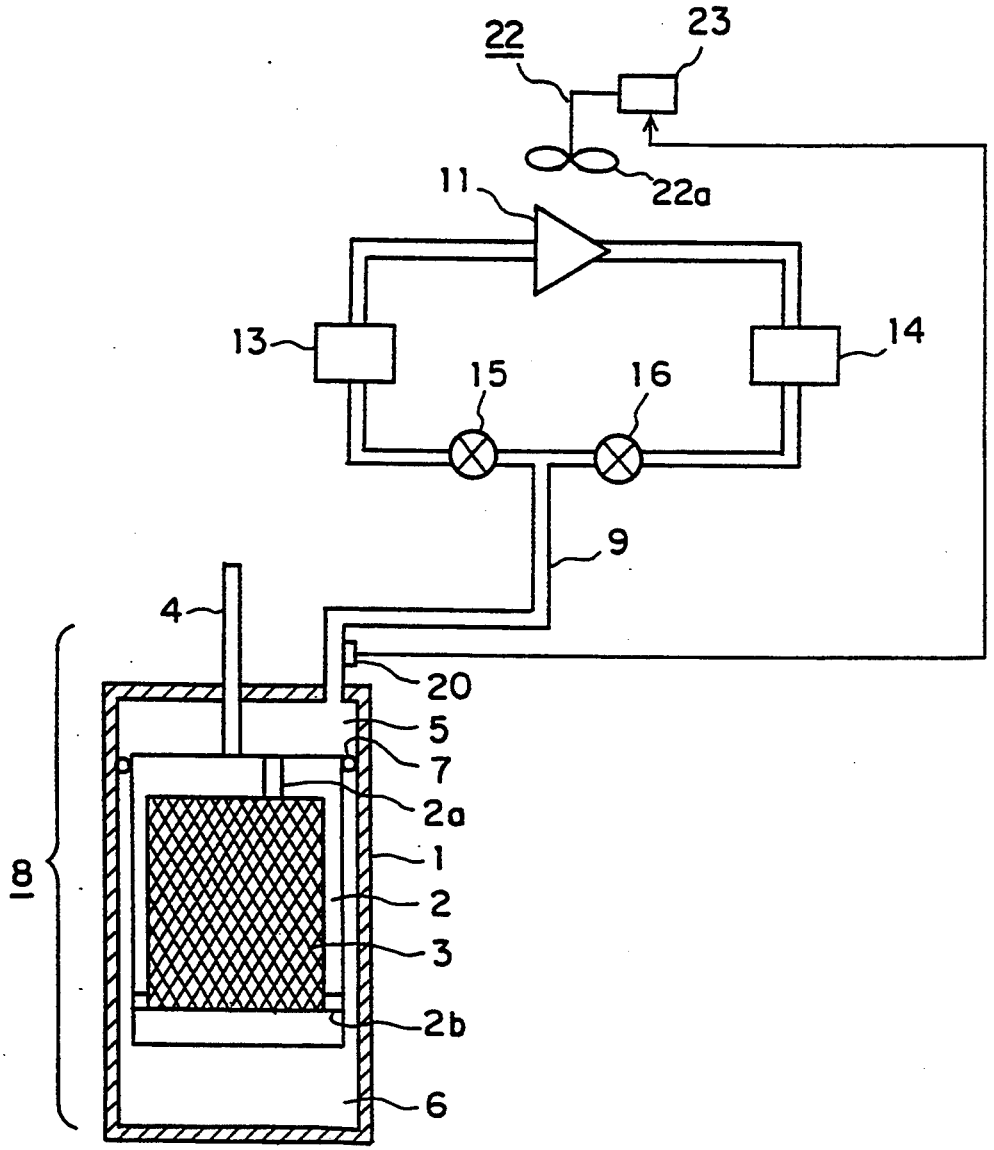
FIG. 6 is a construction diagram showing a low-temperature regenerative type refrigerator according to an embodiment in the second aspect of the invention.

FIG. 6 is a construction diagram showing a single stage type Gifford McMahon cycle refrigerator according to an embodiment in the second aspect of the present invention. In the same figure, an air cooling type cooler 22 having an air-cooling fan **22*a* is disposed in the vicinity of a compressor 11, which is cooled by rotation of the fan 22*a*. In the air cooling type cooler 22 is provided an air-cooling fan controller 23 for controlling the number of revolutions of the fan 22*a*. The controller 23 is connected to a temperature sensor 20 which is disposed near a cylinder 1-side end of a pipe 9 and it controls the number of revolutions of the air-cooling fan 22*a* in accordance with the temperature of gas which is discharged from the compressor 11 and fed to an expansion unit 8**.

In the low-temperature regenerative type refrigerator of this embodiment 4, when the temperature of the gas discharged from the compressor 11 and flowing into the expansion unit 8 drops below a certain level, the number of revolutions of the fan **22*a* is decreased by the air-cooling fan controller 23, whereby the volume of air for cooling the compressor 11 is reduced, so that the gas temperature rises. Thus, the same effects as in the preceding embodiments can be obtained. The second aspect of the present invention is also applicable to such multi-stage low-temperature regenerative type refrigerators of two or more stages as shown in FIGS. 4 and 5**.

Embodiment 5

Figure 7:
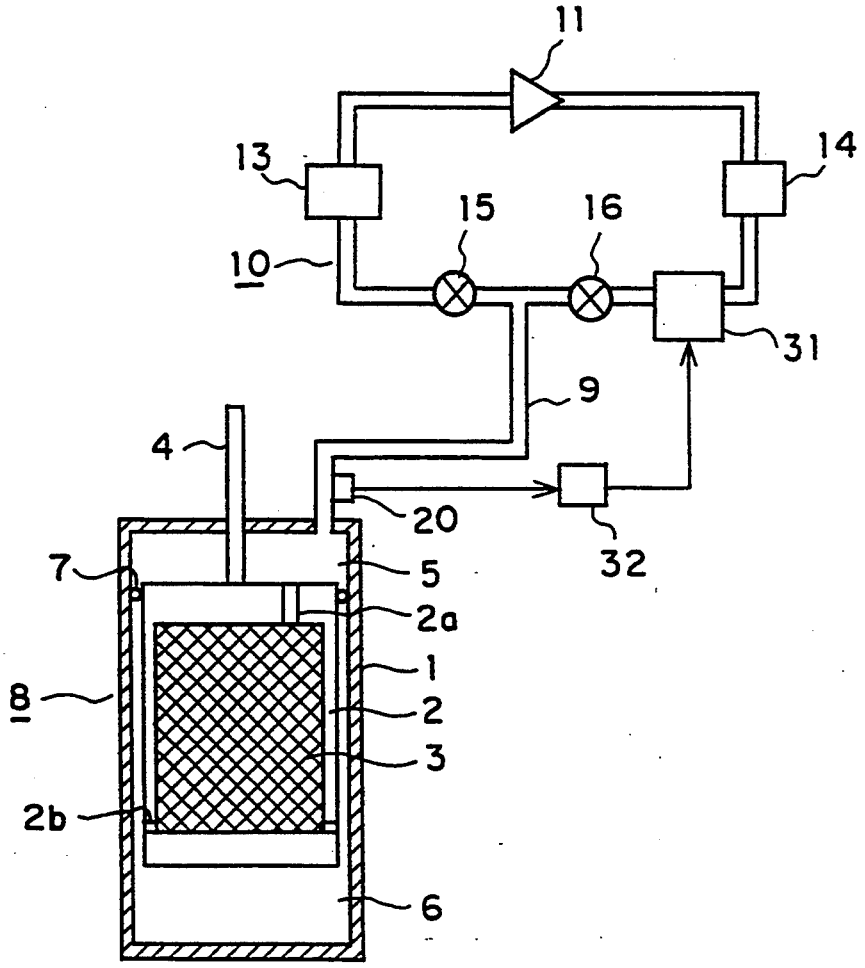
FIG. 7 is a construction diagram showing a low-temperature regenerative type refrigerator according to a first embodiment in the third aspect of the invention.

FIG. 7 is a construction diagram showing single stage type Gifford McMahon cycle refrigerator according to a first embodiment in the third aspect of the present invention. In the same figure, a heater 31 is disposed in a pipe which connects between a high pressure-side surge tank 14 and an intake valve 16 both of a compressor unit 10. The heater 31 functions to heat gas which passes through the said pipe. To the heater 31 is connected a heater controller 32 which controls the quantity of heat of the heater. The heater controller 32, which is connected to a temperature sensor 20, compares a temperature detected by the temperature sensor 20 with a preset temperature and controls the heater 31 in accordance with the result of the comparison so that the detected temperature is always above preset level.

The operation of this refrigerator will now be described. The compressed gas discharged from the compressor 11 is fed to the high pressure-side surge tank 14, and when the intake valve 16 is open, the gas is fed to a normal temperature space 5 of an expansion unit 8. In this case, the temperature of the gas fed to the space 5 is detected continually by the temperature sensor 20 and the detected information is inputted to the heater controller 32, which in turn controls the heater 31 so that the temperature of the gas fed to the space 5 is held above the preset level. Other operations are the same as in the prior art.

In such a low-temperature regenerative type refrigerator, even when it is installed in a place where the ambient temperature is low, the temperature of the gas flowing into an expansion unit 9 is kept higher than the preset level, so that a seal 7 which is in contact with the gas is also heated and hence its thermal shrinkage is prevented. Consequently, the deterioration in function of the seal 7 is prevented and there is no fear of gas leakage between the normal temperature space 5 and an expansion space 6. In addition, the occurrence of convection or deflecting flow is also prevented when the gas passes through a regenerator 3, so that the heat exchange efficiency of the regenerator 3 is not deteriorated and hence the deterioration in the refrigerating capacity of the entire refrigerator is also prevented.

Embodiment 6

Figure 8:
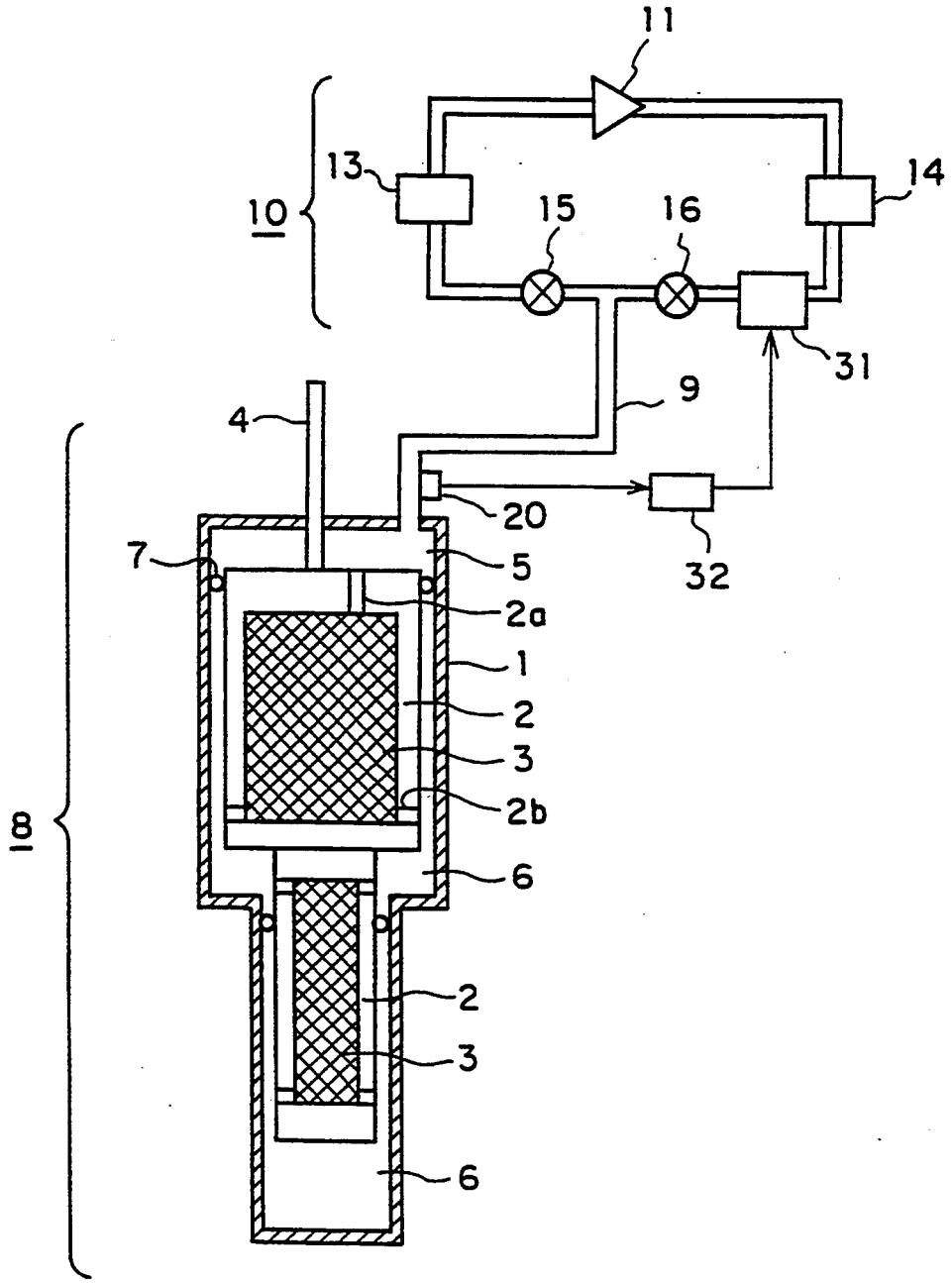
FIG. 8 is a construction diagram showing a low-temperature regenerative type refrigerator according to a second embodiment in the third aspect of the invention.

FIG. 8 is a construction diagram showing a two-stage type Gifford McMahon cycle refrigerator according to a second embodiment in the third aspect of the present invention. As illustrated in the same figure, by providing the heater 31 and the heater controller 32 like the embodiment shown in FIG. 7, the same effects as in the single stage type can be expected also in the two-stage type.

Embodiment 7

Figure 9:
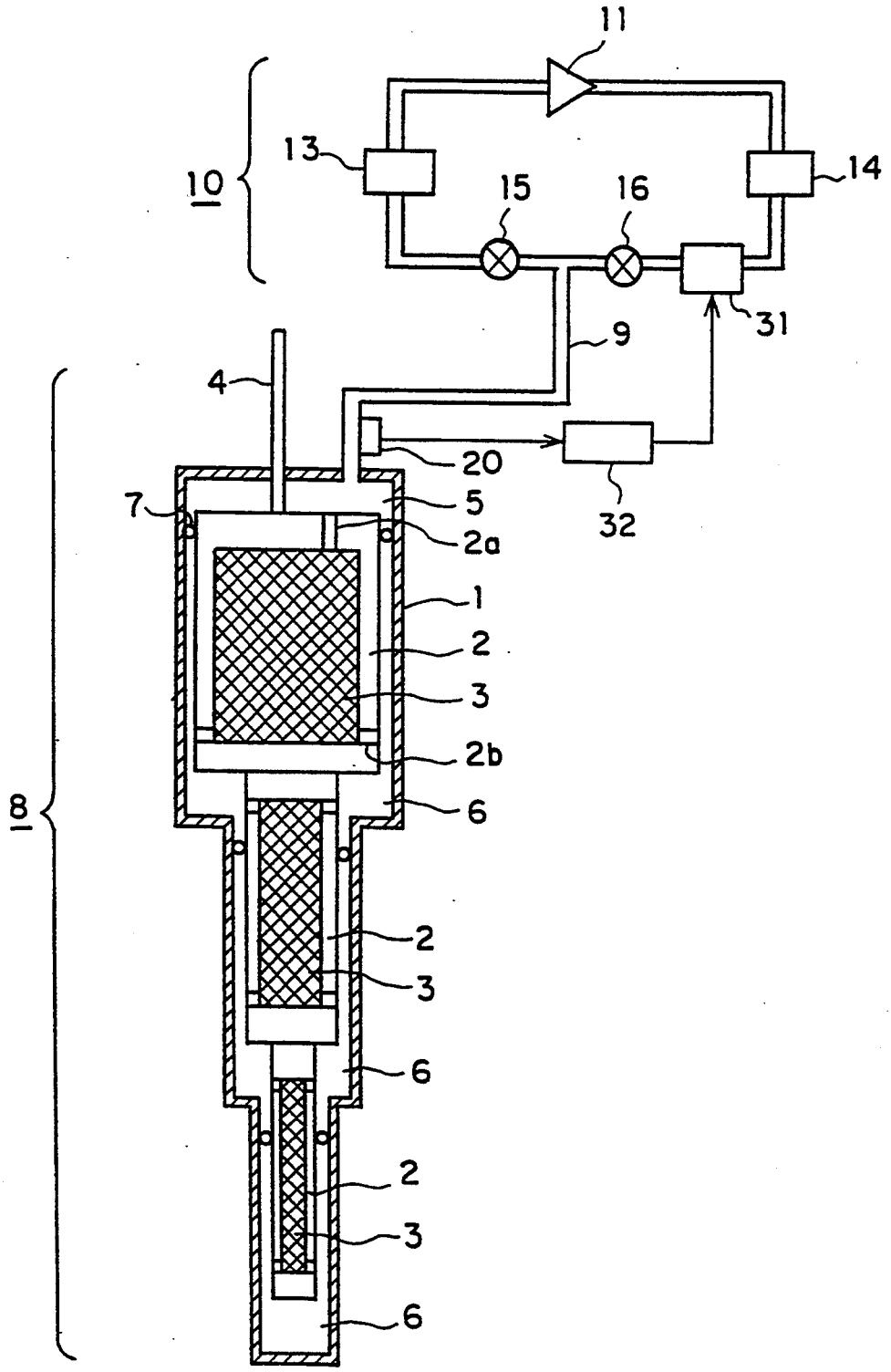
FIG. 9 is a construction diagram showing a low-temperature regenerative type refrigerator according to a third embodiment in the third aspect of the Invention.

FIG. 9 is a construction diagram showing a three-stage type Gifford McMahon cycle refrigerator according to a third embodiment in the third aspect of the present invention. As illustrated in the same figure, by providing the heater 31 and the heater controller 32 like the embodiment shown in FIG. 7, the same effects as in the single stage type can be expected also in a multi-stage type of three or more stages.

Embodiment 8

Figure 10:
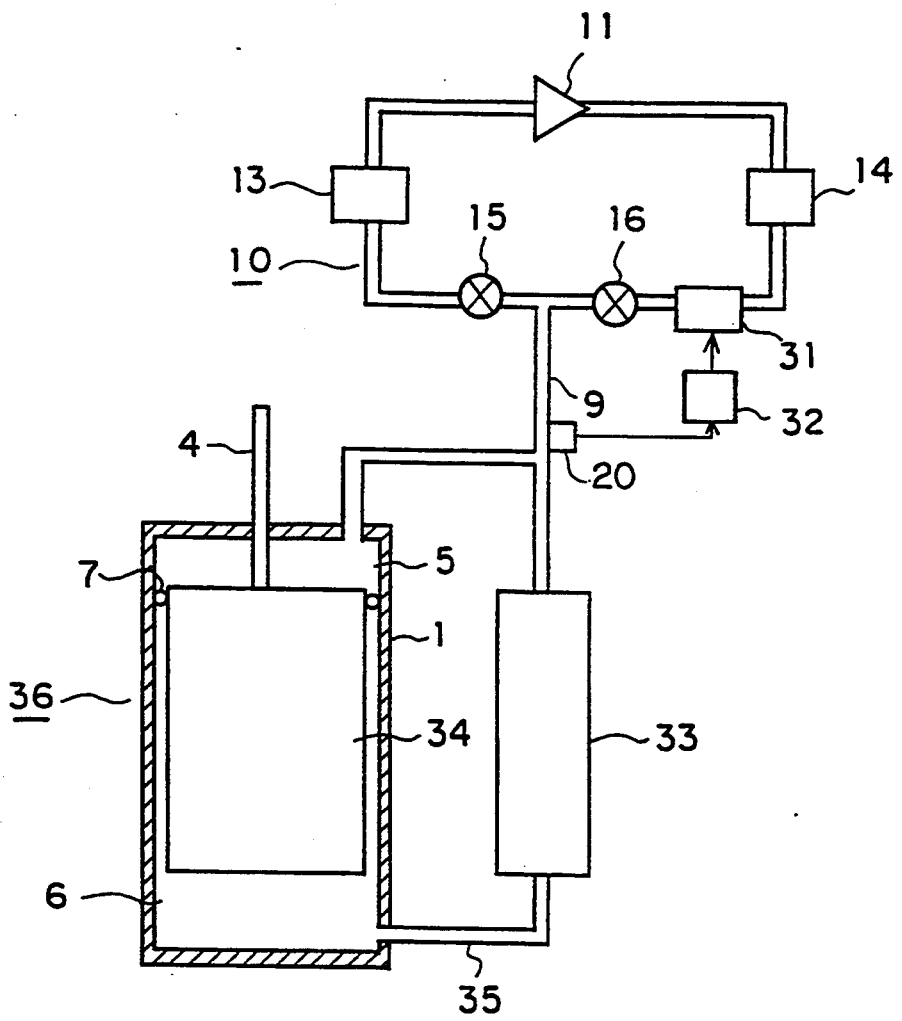
FIG. 10 is a construction diagram showing a low-temperature regenerative type refrigerator according to a fourth embodiment in the third aspect of the invention.

FIG. 10 is a construction diagram showing a Gifford McMahon cycle refrigerator according to a fourth embodiment in the third aspect of the present invention. In the same figure, a regenerator 33 is disposed outside and in parallel with a cylinder 1, and a displacer 34 not containing a regenerator is disposed within the cylinder 1 so that it can slide reciprocatively through a seal 7. A pipe 9 extending from the compressor unit 10 is branched into two pipes, one of which is connected to a normal temperature space 5 in the cylinder 1 and the other connected to one end of the regenerator 33.

A temperature sensor 20, which is connected to the heater controller 32, is mounted near the regenerator 33-side end of the pipe 9. The opposite end portion of the regenerator 33 and an expansion space 6 in the cylinder 1 are connected with each other through a pipe 35. An expansion unit 36 in this embodiment 8 is composed of the cylinder 1, operating rod 4, seal 7, regenerator 33, displacer 34 and pipe 35.

In the low-temperature regenerative type refrigerator of this embodiment 8, the temperature of gas fed to the regenerator 33 is detected continually by the temperature sensor 20 and the detected information is inputted to the heater controller 32, which in turn controls the heater 31 so that the temperature of gas fed to the room temperature space 5 is normally held above a preset level. Therefore, the deterioration in function of the seal 7 caused by heat shrinkage is prevented and the occurrence of convection or deflecting flow in the regenerator 33 is also prevented. Further, the deterioration in the cooling efficiency of the regenerator 33 and in the refrigerating capacity of the entire refrigerator is prevented.

Embodiment 9

Figure 11:
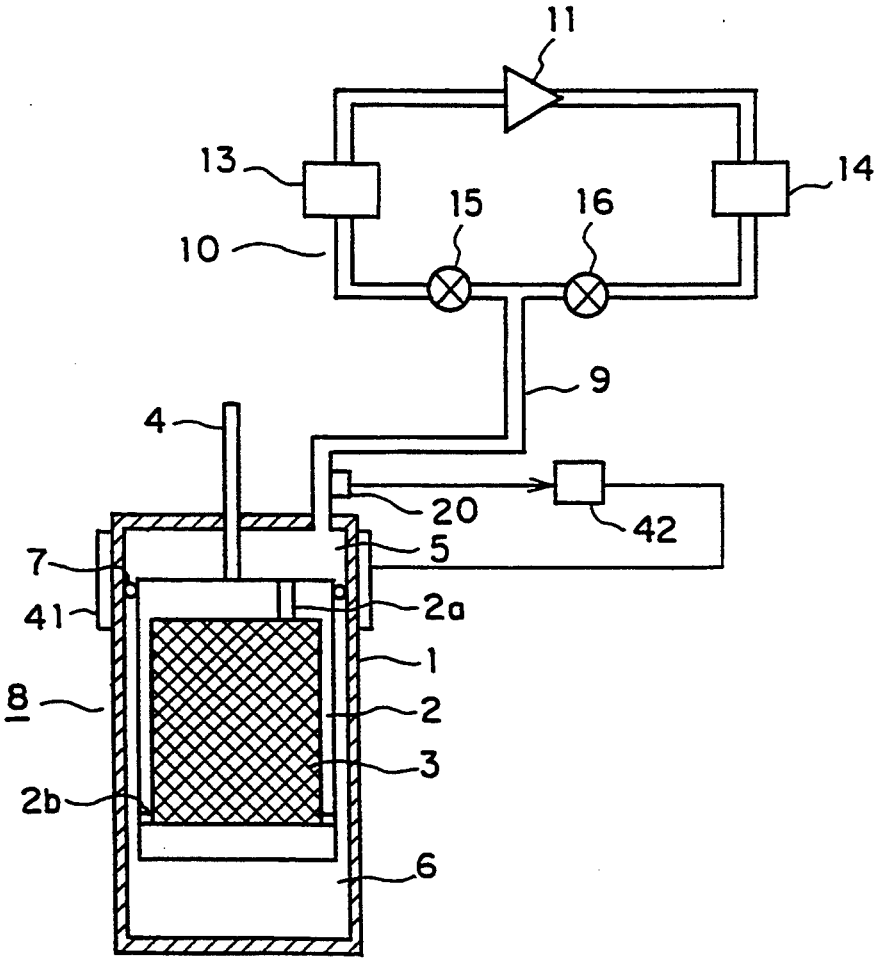
FIG. 11 is a construction diagram showing a low-temperature regenerative type refrigerator according to a first embodiment in the fourth aspect of the invention.

FIG. 11 is a construction diagram showing a single stage type Gifford McMahon cycle refrigerator according to a first embodiment in the fourth aspect of the present invention. In the same figure, a heater 41 for heating the gas in a room temperature space 5 and also heating a seal 7 is disposed on an outer peripheral part corresponding to a seal 7 sliding portion of a cylinder 1. To the heater 41 is connected a heater controller 42 for controlling the quantity of heat from the heater. The heater controller 42, which is connected to a temperature sensor 20, compares a temperature detected by the temperature sensor 20 with a preset temperature and controls the heater 41 in accordance with the result of the comparison so that the detected temperature is always above the preset level.

Reference will now be made to the operation. Compressed gas discharged from a compressor 11 is fed to a high pressure-side surge tank 14, and when an intake valve 16 is open, the gas is fed to a room temperature space 5 in an expansion unit 8. In this case, the temperature of the gas fed to the space 5 detected continually by the temperature sensor 20 and the detected information is inputted to the heater controller 42, which in turn controls the heater 41 so that the gas temperature in the space 5 is held above the preset level. At the same time, the seal 7 is also heated by the heater 41.

Therefore, even if this low-temperature regenerative type refrigerator is installed in a place where the ambient temperature is low, the gas temperature in the room temperature space 5 is held higher than the preset level and the seal 7 is heated, so that a functional deterioration caused by a thermal shrinkage of the seal 7 is prevented. Also prevented is the occurrence of convection or deflecting flow of gas in the regenerator 3 which is caused, for example, by the leakage of gas from the seal 7. As a result, the heat exchange efficiency of the regenerator 3 is not deteriorated and the deterioration in the refrigerating capacity of the entire refrigerator is also prevented.

Embodiment 10

Figure 12:
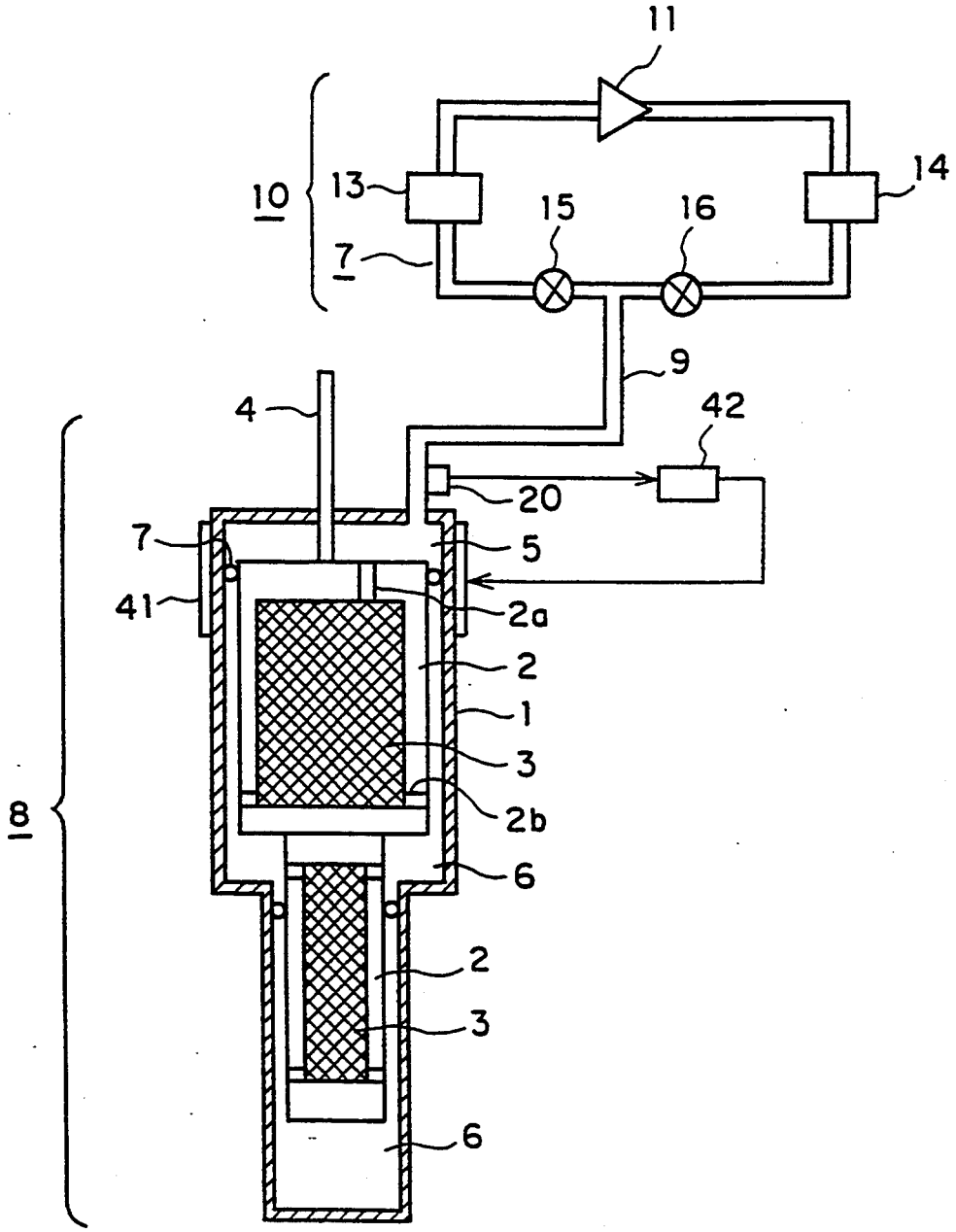
FIG. 12 is a construction diagram showing a low-temperature regenerative type refrigerator according to a second embodiment in the fourth aspect of the invention.

FIG. 12 is a construction diagram showing a two-stage type Gifford McMahon cycle refrigerator according to a second embodiment in the fourth aspect of the present invention. As illustrated in the same figure, by providing the heater 41 and the heater controller 42 like the embodiment shown in FIG. 11, the same effects as in the single stage type can be expected also in the two-stage type.

Embodiment 11

Figure 13:
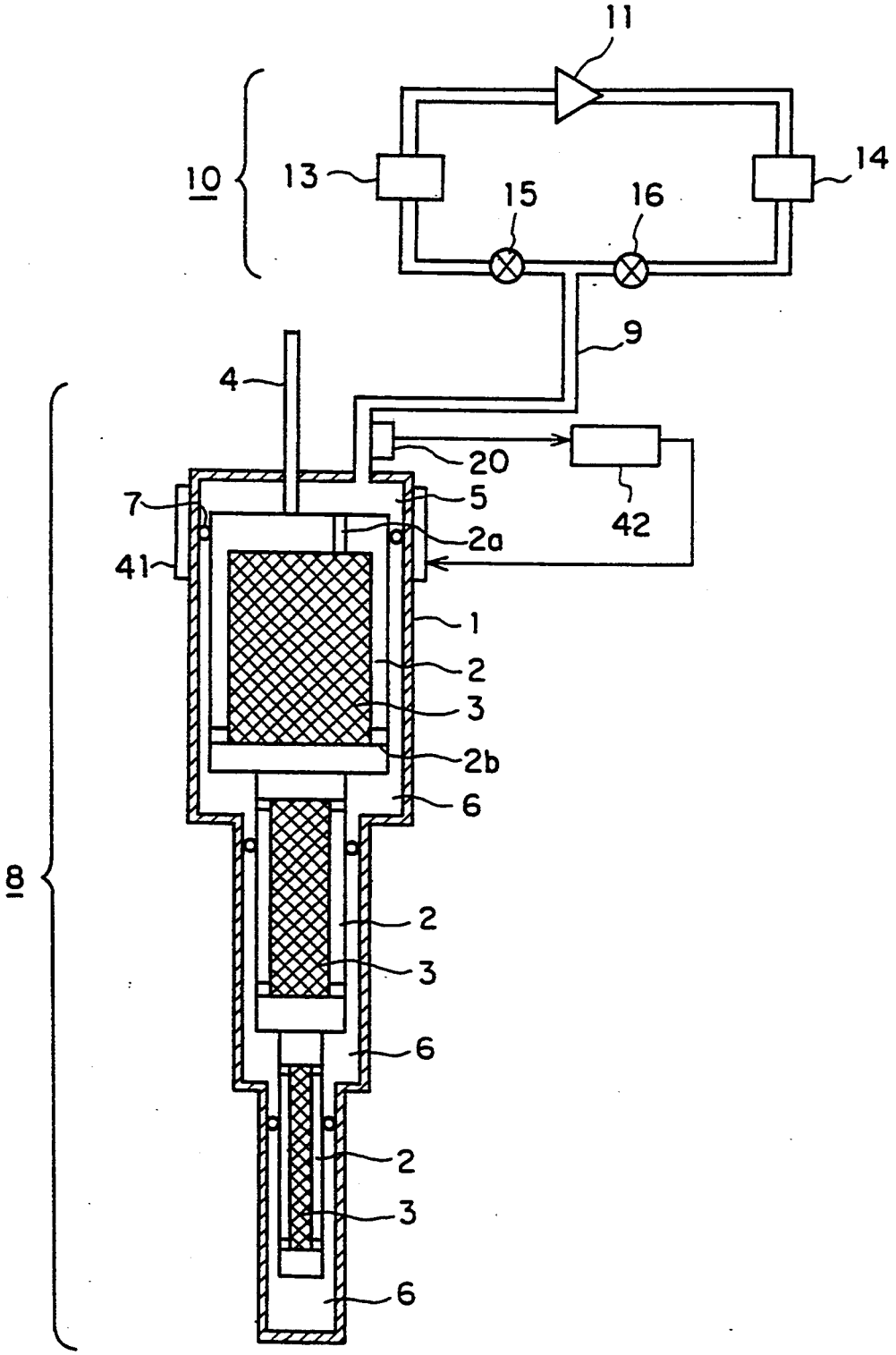
FIG. 13 is a construction diagram showing a low-temperature regenerative type refrigerator according to a third embodiment in the fourth aspect of the invention.

FIG. 13 is a construction diagram showing a three-stage type Gifford McMahon cycle refrigerator according to a third embodiment in the fourth aspect of the present invention. As illustrated therein, by providing the heater 41 and the heater controller 42 like the embodiment shown in FIG. 11, the same effects as in the single stage type can be expected also in a multi-stage type of three or more stages.

Embodiment 12

Figure 14:
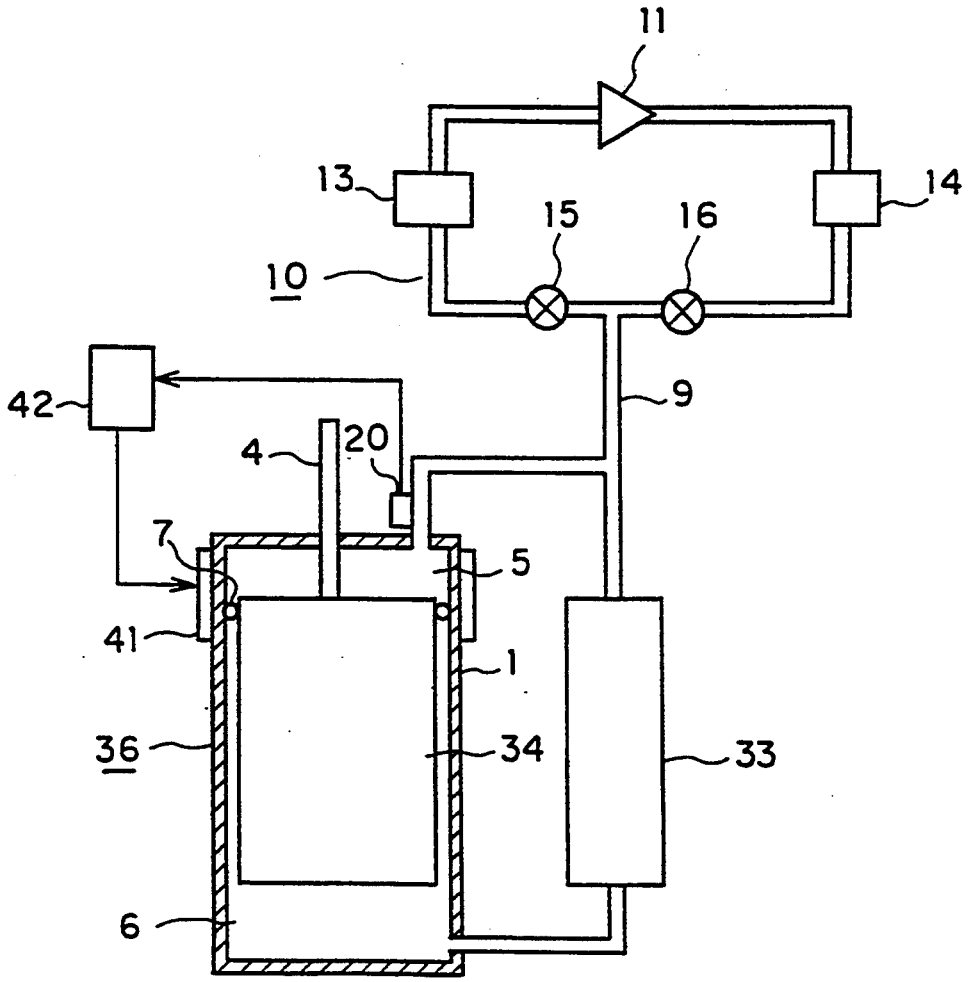
FIG. 14 is a construction diagram showing a low-temperature regenerative type refrigerator according to a fourth embodiment in the fourth aspect of the invention.

FIG. 14 is a construction diagram showing a Gifford McMahon cycle refrigerator according to a fourth embodiment in the fourth aspect of the present invention. In this low-temperature regenerative type refrigerator, like that shown in FIG. 10, a regenerator 33 is disposed outside the cylinder 1. Also in this case, the same effects as in the preceding embodiments 9 to 11 can be expected.

Although Gifford McMahon cycle refrigerators were shown in the above embodiments, it goes without saying that the present invention is also applicable to other low-temperature regenerative type refrigerators such as, for example, Stirling refrigerator, Solvay refrigerator and Vuillemier refrigerator.

As set forth hereinabove, in the low-temperature regenerative type refrigerator in the first aspect of the present invention, since there is provided a cooling water flow rate controller for controlling the flow rate of cooling water in accordance with the temperature of gas which is fed from the compressor to the expansion unit, the temperature of the gas can be kept high to the extent of causing neither a functional deterioration of the seal nor convection or deflecting flow in the regenerator, whereby the deterioration in the cooling efficiency of the regenerator caused by a lowering of the ambient temperature in the refrigerator installed place can be prevented. As a result, there can be attained the effect that the deterioration of the refrigerating capacity as the entire refrigerator can be prevented. Further, since the temperature of the gas discharged from the compressor is raised by reducing the flow rate of cooling water without using a heater or the like, the heat utilization efficiency is high, which is economical.

According to the low-temperature regenerative type refrigerator in the second aspect of the present invention, since there is provided an air-cooling fan controller for controlling the number of revolutions of the air-cooling fan in accordance with the temperature of the gas fed to the expansion unit from the compressor, there are attained the same effects as in the first aspect of the present invention.

According to the low-temperature regenerative type refrigerator in the third aspect of the present invention, there is provided a heater for heating the gas fed to the expansion unit from the compressor and the quantity of heat of the heater is controlled by a heater controller in accordance with the temperature of the said gas, so like the first aspect of the invention, it is possible to prevent the deterioration in the cooling efficiency of the low-temperature regenerative which is caused by a lowering of the atmospheric temperature or ambient temperature in the refrigerator installed place. As a result, there is obtained the effect that the deterioration of the refrigerating capacity as the entire refrigerator can be prevented.

Further, according to the low-temperature regenerative type refrigerator in the fourth aspect of the present invention, since a heater for heating both the gas fed to the expansion unit and the seal is disposed on an outer peripheral part of the cylinder and the quantity of heat of the heater is controlled by a heat controller in accordance with the temperature of the gas fed to the expansion unit from the compressor, there is attained not only the same effect as in the third aspect of the present invention but also the effect that the leakage of gas caused by shrinkage of the seal can be prevented more certainly.

What is claimed is:

1. A low-temperature regenerative type refrigerator comprising:

an expansion unit having a cylinder, a displacer for forming an expansion space within said cylinder, said displacer being disposed within the cylinder so as to be slidable reciprocatively through a seal, and a regenerator for heat exchange of gas which is fed into and discharged from said expansion space;

a compressor for compressing the gas discharged from said expansion unit and feeding the compressed gas to the expansion unit;

a heater for heating the gas fed to said expansion unit and also for heating said seal, said heater being mounted on an outer peripheral part of said cylinder; and a heater controller for controlling the quantity of heat of said heater in accordance with the temperature of the gas fed to said expansion unit from said compressor.

* * * * *